United States Patent [19]

Buchser

[11] 4,084,725

[45] Apr. 18, 1978

[54] ICE PIECE DISPENSER

[75] Inventor: William J. Buchser, Evansville, Ind.

[73] Assignee: Whirlpool Corporation, Benton Harbor, Mich.

[21] Appl. No.: 718,145

[22] Filed: Aug. 26, 1976

[51] Int. Cl.[2] ..... F25C 5/18

[52] U.S. Cl. ..... 221/75; 62/344

[58] Field of Search ..... 221/150 R, 75, 203; 62/344; 222/146 C, 413, 240, 241, 237

[56] References Cited

U.S. PATENT DOCUMENTS

| | | | |
|---|---|---|---|
| 3,075,363 | 1/1963 | Conto | 62/344 X |
| 3,196,624 | 7/1965 | Reynolds | 62/344 X |
| 3,437,244 | 4/1969 | Alvarez et al. | 222/240 |

*Primary Examiner*—Stanely H. Tollberg
*Attorney, Agent, or Firm*—Wegner, Stellman, McCord, Wiles & Wood

[57] ABSTRACT

An ice piece dispenser for automatically dispensing pieces of ice from a collecting bin associated with an automatic ice maker. The dispenser includes a delivery member for transferring the ice pieces from the collecting bin to a delivery position. A metering device is provided at the transfer position between the collecting bin and delivery member for providing a metered delivery of the ice pieces to the delivery member which may have a relatively large delivery capacity so as to permit use of the apparatus in dispensing any one of a plurality of different size and shape ice pieces. The metering device may be any one of a plurality of different metering devices correlated with the size and configuration of the ice pieces intended to be dispensed in the apparatus. The device may define an anti-jamming element at the transfer position for reducing the size of aggregated ice pieces and cause a delivery of independent ice pieces to the delivery member for sequential delivery therethrough to the delivery position. The device may include connecting arms interlocked with the delivery member whereby concurrent rotation of the device and delivery member may be effected. The device may be disposed flush with one end of the delivery member at the transfer position.

15 Claims, 5 Drawing Figures

ICE PIECE DISPENSER

BACKGROUND OF THE INVENTION

1. Field of the Invention

This invention relates to ice piece dispensers and in particular to means for effecting desired sequential delivery of independent ice pieces from a collecting means to a delivery position.

2. Description of the Prior Art

In U.S. Pat. No. 3,602,406 of Dwight W. Jacobus et al., an ice dispenser for a household refrigerator is disclosed having an ice piece collecting bin provided with a front discharge opening. A dispensing means is mounted within the collecting bin and includes a rotatable feed section having one end aligned with the receptacle front wall opening and the opposite end opening to within the collecting bin. Spaced inwardly of the end of the dispensing means within the collecting bin is a square-edged inlet blade which engages and overlaps the rear edges of auger blades provided within the rotatable feed section. The cross-sectional area of the helical passages of the dispensing means is preselected to meter the ice piece flow to cause advance of the ice pieces in a single file arrangement during rotation thereof. To prevent wedging of the ice pieces passing through the helical passages, the passages are caused to have constantly increasing cross section. Throughout the length of the passages, however, the cross section is made small enough to prevent ice pieces from passing one another or attaining a side-by-side positioning thereof within the passages. The inlet blade substantially overhangs the inlet edges of the auger blades.

In another form of ice dispensing means illustrated in U.S. Pat. No. 3,798,923 of John J. Pink et al., a lift wheel is provided for elevating the ice pieces from the front of the collecting bin for discharge to the exterior of the freezer compartment between two freezer doors thereof.

In U.S. Pat. No. 1,095,702 of John B. Burdett, a carbid feed mechanism for acetylene generators is disclosed having partition plates provided with a series of radial openings to define restraining means for restraining the gravity feed of the carbid being delivered from a hopper to a delivery position. The arrangement is such that the carbid passes by gravity through only the slot or opening of the partition plate which is lowest, and as the axis of the drum is horizontal, the radial slots or openings of the partition pass successively the lowest point in the drum as the drum revolves. The slots thus serve as gate means which periodically permit carbid to pass. A separate shaft is oscillated within the hopper to break up any bridging of the carbid and prevent clogging of the dispensing means.

Gordon H. Strite, in U.S. Pat. No. 3,174,651, shows an apparatus for preparing animal feeds wherein disc segments are adjustably facially juxtaposed to define an adjusted opening at the inlet to a tubular delivery portion of the apparatus. The Strite structure is similar to the Burdett structure in providing the transfer opening at the bottom of the inlet so that the particulate material is fed along the bottom of the delivery tube to the outlet chute.

SUMMARY OF THE INVENTION

The present invention comprehends an improved ice piece dispensing apparatus having improved metering means at a transfer position at the inlet to a delivery member.

The delivery member is disposed externally of the collecting bin and the transfer position is adjacent an outlet opening of the collecting bin at an inlet opening of the delivery member.

The metering means may be disposed flush with the end of the delivery member which may comprise a tubular drum.

The drum may define one or more passages, each having a relatively large ice piece conducting capacity whereby small ice pieces may be delivered therethrough in side-by-side relationship. However, the metering means is arranged to meter the delivery so that the ice pieces are delivered sequentially independently.

The metering means may comprise a disc having an irregular periphery and, in the illustrated embodiment, having an undulate periphery for effecting a rolling motion to the ice pieces engaged thereby. Extending outwardly from the disc is suitable connecting means which, in the illustrated embodiment, comprises a pair of arms having distal ends received in notches in the delivery member drum end at the transfer position whereby the metering means may be effectively flush with the end of the drum.

The invention further comprehends the provision of the disc means and connecting arm portions to define an anti-jamming means at the transfer position. The metering means constantly agitates ice pieces in the vicinity of the drum entrance and includes cutting means for reducing the size of aggregated ice pieces to cause a delivery of independent ice pieces to the delivery member passage for sequential delivery therethrough to the delivery position. The ice agitation and cutting action effected by the metering means minimize the tendency of ice pieces to build up and jam at the entrance to the drum.

By suitably selecting the size of the disc element, the apparatus is adapted for use in transferring different size and different configuration ice pieces. As the metering of the ice pieces is effected at the inlet to the delivery means, the ice pieces may pass through the delivery means in independent single file arrangement.

Thus, the ice piece dispensing apparatus of the present invention is extremely simple and economical of construction while yet providing the highly desirable features discussed above.

BRIEF DESCRIPTION OF THE DRAWING

Other features and advantages of the invention will be apparent from the following description taken in combination with the accompanying drawing wherein.

DESCRIPTION OF THE PREFERRED EMBODIMENT

Figure 1:
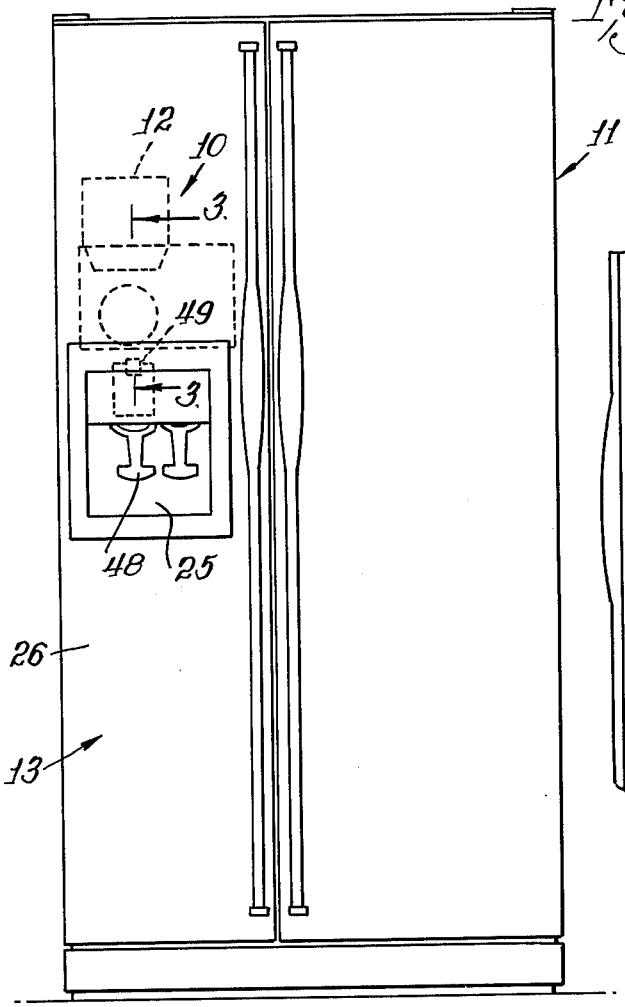
FIG. 1 is a front elevation of a refrigerator having an ice piece dispensing apparatus embodying the invention.
Figure 2:
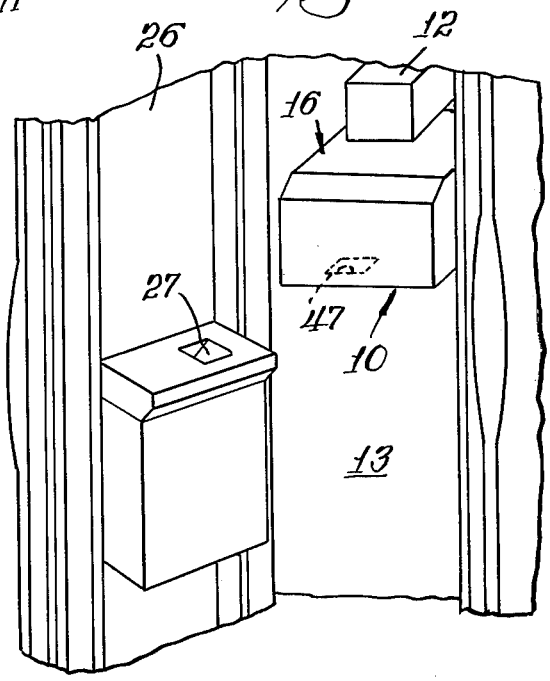
FIG. 2 is a perspective view illustrating the arrangement of the apparatus with the freezer door in an open position.

In the exemplary embodiment of the invention as disclosed in the drawing, an ice piece dispensing apparatus generally designated 10 is mounted in a refrigeration apparatus, such as a side-by-side refrigerator-freezer apparatus generally designated 11.

Figure 3:
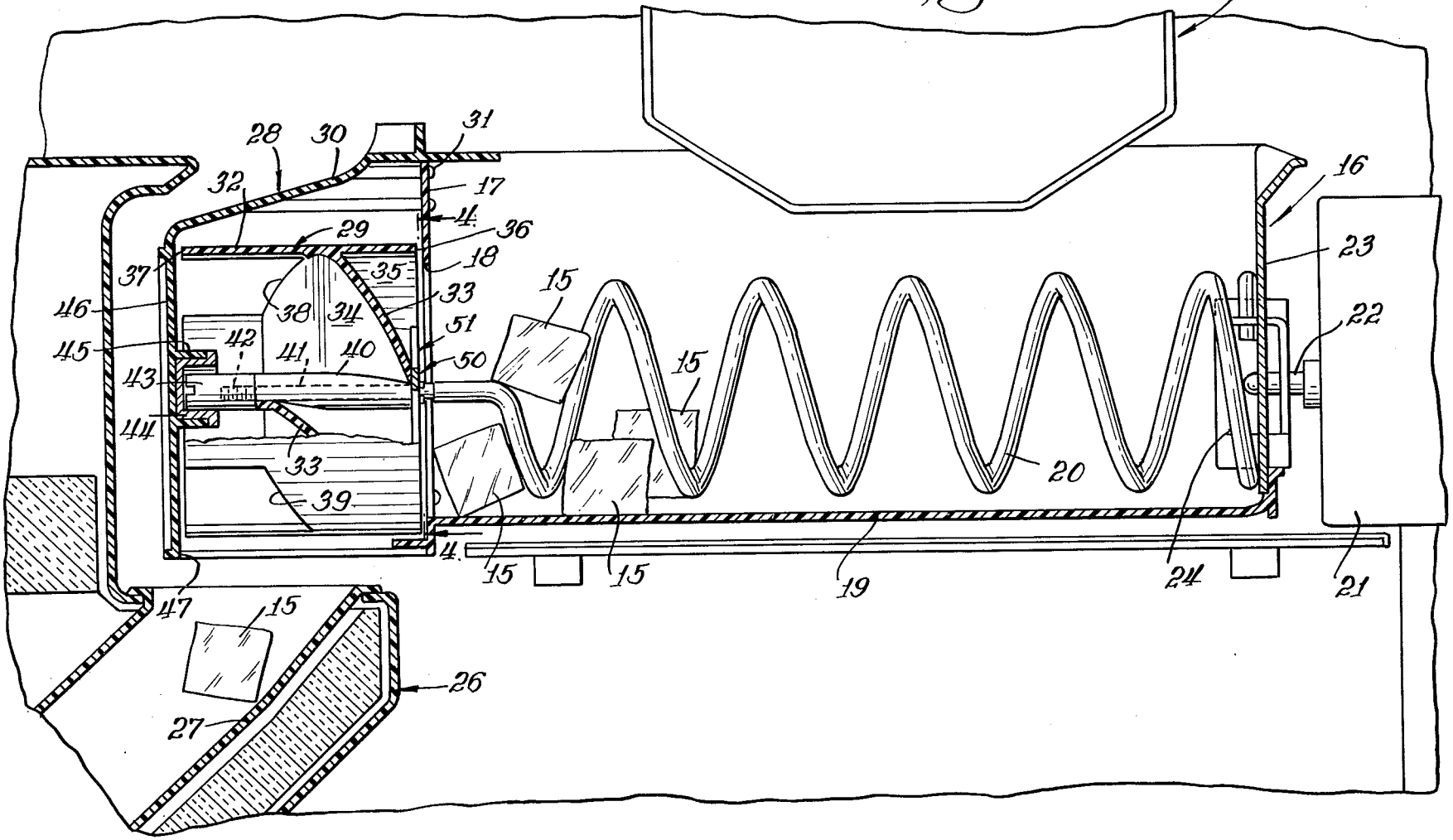
FIG. 3 is a fragmentary enlarged vertical section taken substantially along the line 3—3 of FIG. 1.

Apparatus 11 includes an automatic ice maker 12 which may be of any suitable construction, as well known to those skilled in the art. The ice maker, as shown in FIG. 1, may be installed in the freezer portion 13 of apparatus 11. As shown in FIG. 3, ice pieces 15 formed by ice maker 12 are delivered therefrom into a collecting bin 16 where they may be stored until withdrawn for use. The collecting bin includes a front wall 17 having an opening 18. Overlying the bottom wall 19 is a helical wire auger 20 adapted to be rotated by a drive motor 21 having a shaft 22 extending through the rear wall 23 of the collecting bin and engaging a connector 24 at the rear end of the helical wire 20. Rotation of the wire auger 20 causes ice pieces 15 collected within the bin to be urged forwardly through the opening 18. Operation of motor 21 may be effected by any suitable control means for selective dispensing of the ice pieces by the user.

In the present embodiment, the ice pieces may be delivered to an external service area 25 in the freezer door 26. As shown in FIG. 3, the freezer door may be provided with a forwardly and downwardly inclined chute 27 for passing the ice pieces through the door to the service area 25. The present invention comprehends an improved means for providing a metered delivery of the ice pieces into the chute 27.

More specifically, as best seen in FIG. 3, the ice piece transferring means generally designated 28 includes a delivery member 29 received in a front housing 30 secured to the collecting bin front wall 17 by suitable means, such as screws 31.

The delivery means 29 is defined by a tubular drum 32 having a helical flight 33 dividing the interior of the drum into a pair of helical passages 34 and 35. The drum defines a rear end 36 and a front end 37. Adjacent the front end 37, the drum is provided with a pair of outlet openings 38 and 39 associated respectively with the ice conducting passages 34 and 35. The drum is further provided with an axial tubular hub 40. The helical auger wire includes a rectilinear end portion 41 projecting through the hub and having a threaded end 42 to which is threadedly secured a pivot element 43. The pivot element is rotatively mounted in a bearing 44 carried in an annular boss 45 on the front wall 46 of the housing 30.

Housing 30 further defines a lower outlet opening 47 which overlies chute 27 when the freezer door 26 is in the closed position of FIG. 3. Thus, ice pieces 15 may be delivered through the delivery means 29 from the collecting bin 16 into the delivery chute 27 during a dispensing operation. To effect such a dispensing operation, the apparatus is provided with an acutator 48 accessible at the service station 25 to be engaged by a suitable receiver, such as a cup or glass (not shown). The acutator may operate a suitable electric switch 49 for controlling the drive motor 21 to effect the desired dispensing of the ice pieces.

Rotation of the helical auger wire 20 causes the ice pieces to move forwardly through the collecting bin opening 18 and into the helical delivery passages 34 and 35 of the delivery means. The delivery passages are relatively large in cross section. Illustratively, they may have a cross section sufficiently large to permit disposition of small ice pieces therein in side-by-side relationship. It is desirable, however, that the ice pieces be delivered in a metered fashion for sequential delivery thereof through the chute 27 to the service station. To assure such metering of the ice pieces, the apparatus 10 is provided with a metering means generally designated 50. The entrance to the passages 34 and 35 within drum end 36 defines a transfer position 51 immediately forwardly of the opening 18 of the collector bin wall 17. The metering means 50 is disposed at the transfer position for effecting a metering of the ice pieces prior to the delivery thereof into the delivery passages 34 and 35. Means 50 further defines anti-jamming means for reducing the size of aggregated ice pieces to cause a delivery of independent ice pieces into the delivery passages 34 and 35 and concurrently effect a rolling of the ice pieces at the transfer position to maintain unjammed continuous movement of the ice pieces during the dispensing operation.

Figure 4:
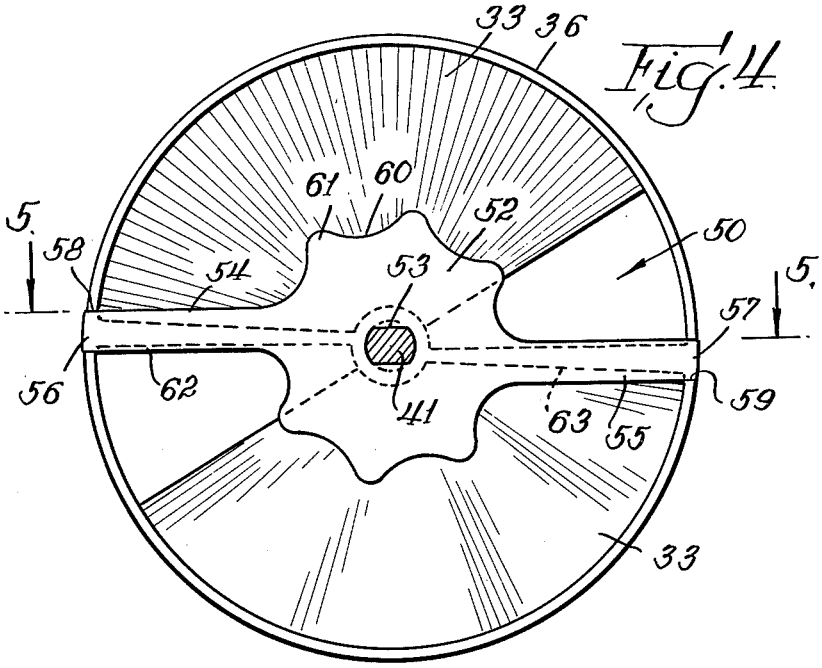
FIG. 4 is a fragmentary further enlarged vertical section taken substantially along the line 4—4 of FIG. 3.
Figure 5:
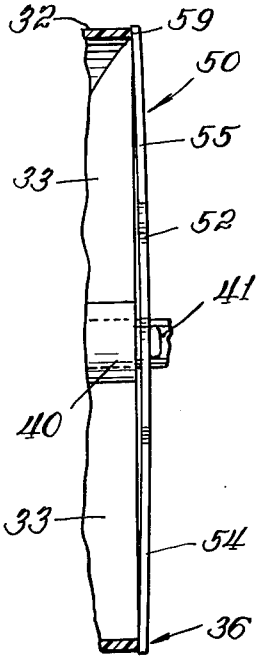
FIG. 5 is a fragmentary section taken substantially along the line 5—5 of FIG. 4.

As best seen in FIGS. 4 and 5, the metering and anti-jamming means 50 comprises a disc 52 having an oblong opening 53 which is complementary to and fitted on the end portion 41 of the drive wire 20, whereby the disc is rotated concurrently with the drive wire about the longitudinal axis of the motor shaft 22.

Projecting outwardly from the disc is a pair of opposed arms 54 and 55 having distal ends 56 and 57, respectively, received in notches 58 and 59 at opposite portions of the drum end 36. Thus, rotation of the disc 52 by drive wire 20 causes a concurrent rotation of delivery means 29 by the driving action of the arms 54 and 55 on drum 32 while the drum provides an outboard support for the arms stabilizing and strengthening the assembly.

Alternatively, rotational motion may be coupled to the delivery means 29 by virtue of a secure connection with portion 41 of the drive wire 20, instead of by coupling from portion 41 of the drive wire through element 50 to the delivery means 29. In such case, element 50 nonetheless rotates with delivery means 29, due to its engagement with notches 58 and 59 of the drum end 36.

As best seen in FIG. 5, element 50 may be disposed substantially flush with the end 36 of drum 32.

The periphery 60 of disc portion 52 is provided with a plurality of outwardly projecting portions 61, and more specifically in the illustrated embodiment, periphery 60 is undulate. It has been found that such an undulate configuration provides a continual rolling action relative to the ice pieces engaged thereby so as to keep the ice pieces in the vicinity of the drum end 36 in motion during a dispensing operation. This effectively prevents jamming of the ice pieces at the transfer position 51 and assures the independent delivery of the ice pieces into the transfer passages 34 and 35, as discussed above. In addition to maintaining a rolling motion of the ice at the transfer position, the projections 61 tend to break up or cut masses of ice, such as aggregated ice pieces, so as to provide the desired sequential delivery of the ice pieces to the delivery chute 27. As the metering of the ice piece delivery is effected at the transfer position prior to the movement of the ice pieces into the passages 34 and 35, the metered ice pieces may be readily delivered through the transfer passages notwithstanding a wide variation in the configuration or size of the ice pieces. Thus, by suitable interchange of any one of a plurality of different elements 50 having different size disc portions 52, the apparatus 10 is easily adapted for use with various ice makers providing a wide range of different size and shape ice pieces.

In addition to varying the size of the disc portion 52, the configuration of the undulate periphery 60 may be varied to effect the desired optimum metering and anti-jamming functioning relative to the different size and shape ice pieces with which the apparatus is used.

The elements 50 may be interchanged by means of the simple ready removable mounting thereof on the drive wire end 41. More specifically, removal of the housing 30 and delivery means 29 may be effected by removal of screws 31 to permit the removal of housing 30 from the assembly. Subsequent removal of the threaded element 43 permits the removal of the delivery means for substitution of a different element 50, as desired.

As further shown in FIG. 4, the arms 54 and 55 are generally coextensive with the leading edges 62 and 63 of the flights 33. The aligned relationship of the arms with the flight edges provides an improved control of the delivery of the ice pieces from the transfer position into the helical passages 34 and 35.

Drum 32, flights 33, and hub 40 may be formed as a one-piece molded synthetic resin element for simplicity of construction and low cost. Element 50 may be formed of stamped metal. Thus, the ice piece transferring means of the present invention is extremely simple and economical of construction while yet providing the improved metered sequential delivery of the ice pieces in the dispensing operation as discussed above.

The foregoing disclosure of specific embodiments is illustrative of the broad inventive concepts comprehended by the invention.

Having described the invention, the embodiments of the invention in which an exclusive property or privilege is claimed are defined as follows:

1. In an ice piece dispensing apparatus having means for providing a plurality of ice pieces to a transfer position, and a delivery member having a through passage for conducting ice pieces away from said transfer position to a delivery position, the improvement comprising metering means at said transfer position for providing a metered, sequentially independent delivery of said ice pieces one at a time to said passage at a rate substantially less than the maximum delivery capacity of said passage, said metering means being defined by a disc element having a plurality of outwardly extending projections restricting free movement of the ice from the transfer position into said passage.

2. The ice piece dispensing apparatus of claim 1 wherein said passage has a maximum delivery capacity permitting delivery of ice pieces therethrough in side-by-side relationship.

3. The ice piece dispensing apparatus of claim 1 wherein said disc element has a diameter substantially less than the transverse dimension of the delivery member at said transfer position.

4. The ice piece dispensing apparatus of claim 1 wherein said metering means comprises a rotated disc element.

5. The ice piece dispensing apparatus of claim 1 wherein said disc element has an undulate periphery.

6. The ice piece dispensing apparatus of claim 1 wherein said disc element has a diameter substantially less than the transverse dimension of the delivery member at said transfer position and at least one connecting means extending from the disc element to said delivery member, and said metering means is rotated about a drive axis to revolve said delivery member concurrently about said axis.

7. The ice piece dispensing apparatus of claim 1 wherein said delivery member comprises a tubular drum having an end at said transfer position, and said metering means is flush with said end.

8. In an ice piece dispensing apparatus having means for providing a plurality of ice pieces to a transfer position, which ice pieces may at times become aggregated, and a delivery member having a through passage for conducting ice pieces away from said transfer position to a delivery position, said passage being sufficiently large in cross section to accommodate said ice pieces in side-by-side relationship, the improvement comprising rotated anti-jamming means at said transfer position for agitating and reducing the size of aggregated ice pieces to cause a delivery of independent ice pieces one at a time into said passage for sequential delivery therethrough to said delivery position, said anti-jamming means being defined by a disc element having an undulate peripheral portion arranged to roll said ice pieces at said transfer position and restrict free movement of the ice pieces from the transfer position into said passage.

9. The ice piece dispensing apparatus of claim 8 wherein said anti-jamming means peripheral portion defines a plurality of outwardly extending projections.

10. The ice piece dispensing apparatus of claim 8 wherein said anti-jamming means comprises any one of a plurality of different size elements, and means for selectively rotatively mounting any selected one of said elements transversely to said passage at said transfer position.

11. The ice piece dispensing apparatus of claim 8 wherein said delivery member comprises a tubular drum having an end at said transfer position, and said anti-jamming means is flush with said end.

12. The ice piece dispensing apparatus of claim 8 wherein said anti-jamming means further defines means for metering delivery of ice pieces to said passage at a rate substantially less than the maximum delivery capacity of said passage.

13. The ice piece dispensing apparatus of claim 8 wherein said disc element carries a pair of opposed, outwardly extending arms engaging the delivery member, and means are provided for rotating said disc element about the axis thereof and thereby causing said arms to concurrently rotate said delivery member.

14. The ice piece dispensing apparatus of claim 8 wherein said disc element carries a pair of opposed, outwardly extending diametrically offset arms engaging the delivery member, and means for rotating said disc element about the axis thereof and thereby causing said arms to concurrently rotate said delivery member.

15. The ice piece dispensing apparatus of claim 8 wherein said passage is helical.

* * * * *